United States Patent [19]

Wright

[11] 4,073,367

[45] Feb. 14, 1978

[54] LEVEL SUPPORT GUARD

[75] Inventor: Allen C. Wright, Moraga, Calif.

[73] Assignee: Utility Products, Inc., Oakland, Calif.

[21] Appl. No.: 728,308

[22] Filed: Sept. 30, 1976

[51] Int. Cl.[2] ..... E06C 7/44

[52] U.S. Cl. ..... 182/204

[58] Field of Search ..... 182/204, 205, 184, 201; 248/188.5, 188.2, 188.8, 410, 354 L, 355, 408

[56] References Cited

U.S. PATENT DOCUMENTS

| | | | |
|---|---|---|---|
| D. 230,370 | 2/1974 | Kaye | D25/68 |
| 1,229,218 | 6/1917 | Bryant | 182/205 |
| 3,021,921 | 2/1962 | Poelvoorde | 182/201 |
| 3,065,982 | 11/1962 | Dodd | 248/410 |

*Primary Examiner*—Reinaldo P. Machado

[57] ABSTRACT

In a ladder leveler of the type manually actuated through a clutch plate to free a leg extension for adjustibility purposes, a protective guard is applied to the clutch plate in a manner to preclude forces being accidently applied to the clutch plate when the leveler is in use to thereby avoid possibility of tragic accidents.

1 Claim, 3 Drawing Figures

LEVEL SUPPORT GUARD

My invention relates to ladder levelers, and in particular to the type which are individually applied to a side rail of the ladder and then adjusted when the ladder is put to use, to assure the ladder is level despite a non-level surface on which it must rest.

Levelers of this type to which the present invention relates, in general comprise a leg extension and a manually releasable clutch assembly which enables the leg extension to be released for adjustment to a position which will insure a stable level condition for the ladder to which the leveler may be affixed.

Though a leveler is designed for application of manual pressure to affect release of the clutch for adjustment purposes, it cannot distinguish the source of a force, but merely respond to it. Consequently, should such a force be applied accidentally while a ladder is occupied, the consequences could be tragic. Such a force could accidentally be applied in the event a falling piece of lumber should strike the leveler, or should one, without thinking, rest a foot on the clutch plates and accidently release the clutch mechanism.

Among the objects of my invention are:

1. To provide a novel and improved ladder leveler of the type attachable to one side rail of a ladder;

2. To provide a novel and improved ladder leveler of the type attachable to one side rail of a ladder and which would not be exposable to accidental release.

Additional objects of my invention will be brought out in the following design of a preferred embodiment of the same taken in conjunction with the accompanying drawings wherein FIG. 1 is a side view in elevation of the improved ladder leveler of the present invention;

Figure 3:
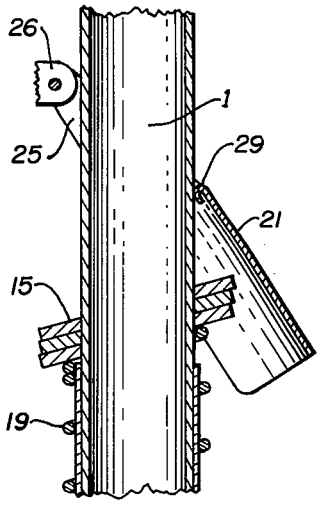
FIG. 3 is a partial side view in section of the ladder leveler depicting the invention in protective position.
Figure 1:
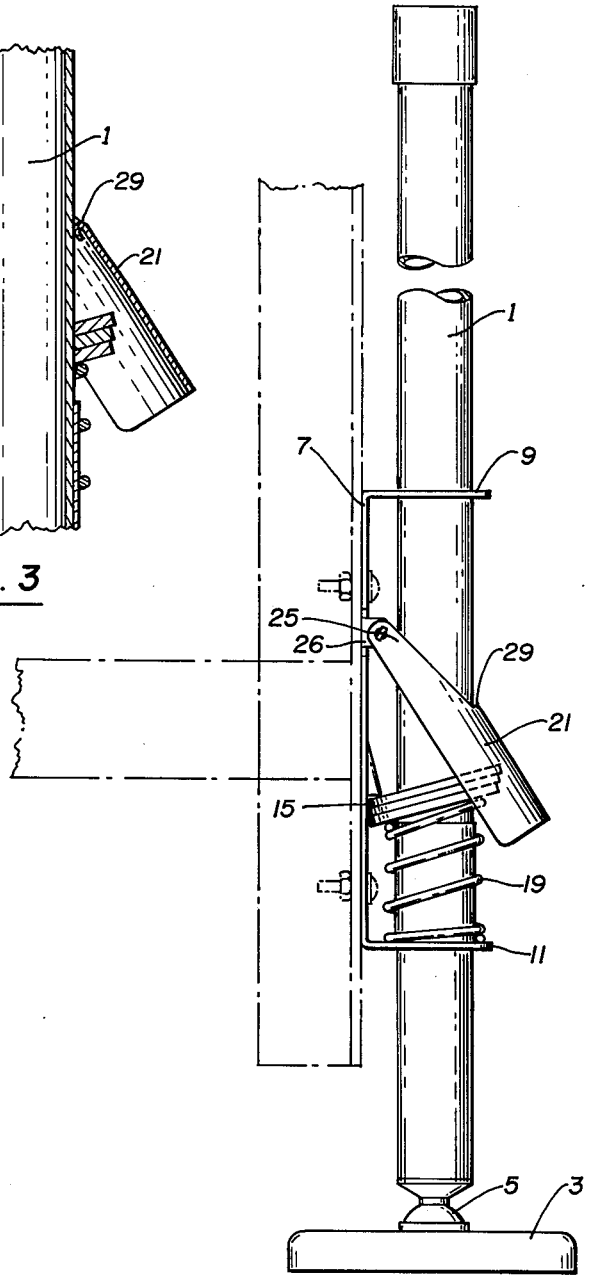
Figure 2:
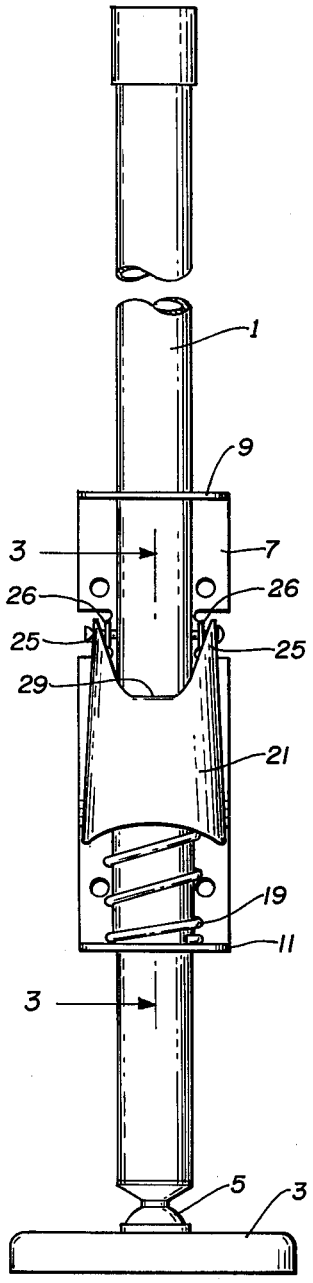
FIG. 2 is a front view in elevation of the ladder leveler of FIG. 1.

For details of my invention in its preferred form, reference will be had to the accompanying drawings wherein the device includes a tubular leg extension 1 terminating at one end in a foot 3, such foot being pivotal about a ball 5 on the end of such leg extension.

A bracket slidably mounted on the leg extension, comprises a mounting plate 7 having lateral wings 9, 11 at each end, such wings having aligned holes to receive the leg extension.

One or more clutch plates 15, each having a hole therethrough to loosely receive the leg extension, are anchored at an intermediate point along the mounting plate by engaging with a protection protruding from such plate and are resiliently held in place by a spring 19 interposed about the leg between the clutch plates and the bottom wing 11, such that a lifting force is normally exerted against the plates to normally cause such to bite into the leg extension to preclude movement of the leg extension in one direction relative to the clutch plates.

To release the clutch for movement of the leg in the opposed direction, a force need be applied to the exposed end of the clutch plate in opposition to the spring force. Generally such force is applied by using ones fingers to grip the exposed end of the clutch plates and the lower wing to apply such pressure.

A aforementioned structure is prior art.

The present invention involves in combination with the foregoing device, a safety means for assuring protection against accidental stimulating of the clutch plates and the hazards which could result therefrom.

Toward accomplishing this purpose, a protective shroud 21 is applied to the leg extension to prevent accidental applying of pressures to the plates that might otherwise release the clutch mechanism and allow the leg extension to readjust itself and permit tipping of the ladder. The shroud, is preferably arcuate in section and notched at one end, to enable the same to straddle the leg extension and create a pair of ears 25 for loosely and hingedly securing the same to corresponding ears 26 extending from the mounting plate 7. The depth of the notch is just sufficient to cause the shroud to drop into contact with the leg extension at a relatively steep angle and not come to rest against the clutch plates. The hinged connection allows the shroud to be raised when necessary for manually gripping the clutch plates to adjust the leg extension.

A curved lip 29, depending from the shroud at the point of engagement with the extension will avoid nicking of the leg extension and help in maintaining the contour of the shroud.

With the shroud in place, any accidental forces which would otherwise strike the clutch plates, first contact the protective shroud and are transferred into the leg extension without affecting the clutch. Also, due to the angle of the shroud, the cause of such accidental force is deflected away from the clutch mechanism.

From the foregoing description of my invention in its preferred form it will be apparent that the same is subject to alterations and modification without departing from the underlying principles involved, and I accordingly, do not desire to be limited in my protection to the specific details illustrated and described, except as may be necessitated by the prior art.

I claim:

1. A leveler for a ladder or the like comprising a leg extension terminating at one end in a foot, a clutch assembly slidably mounted on said leg extension in normally clutching engagement therewith, means for manually releasing said clutch assembly from such clutching engagement with said leg extention to enable sliding adjustment of said clutch assembly with respect to said leg extension, means for attaching said clutch assembly to a side rail of a ladder, and means protecting said clutch assembly from accidental downward impact capable of releasing said clutch assembly from such clutch engagement with said leg extension, said clutch assembly including a bracket slidably mounted on said leg extension, said bracket comprising a mounting plate having a lateral wing on each end, said wings having aligned holes to receive said leg extension, at least one clutch plate anchored along an edge of said mounting plate and having a hole therethrough to loosely receive said leg extension, resiliant means exerting a lifting force against said plate to normally cause said plate to bite into said leg extension to preclude movement of said leg extension in one direction relative to said clutch assembly, said manual means for releasing said clutch assembly from such engagement with said leg extension comprising an exposed end of said clutch plate and one of said wings to enable one to apply a force to said clutch plate in opposition to said resiliant means, and said protecting means comprising a shroud loosely secured at one end to said mounting plate at a location substantially above the exposed end of said clutch plate and extending beyond said end at a rather steep angle to protect said clutch plate against accidental vertical impact forces sufficient to release said clutch plate and permit relative movement between said clutch assembly and said leg extensions.

* * * * *